US011919089B2

(12) United States Patent
Franz et al.

(10) Patent No.: US 11,919,089 B2
(45) Date of Patent: Mar. 5, 2024

(54) METHOD AND DEVICE FOR BREAKING UP AN ELECTRICALLY CONDUCTIVE LIQUID

(71) Applicant: ALD VACUUM TECHNOLOGIES GMBH, Hanau (DE)

(72) Inventors: Henrik Franz, Freigericht-Horbach (DE); Sergejs Spitans, Frankfurt am Main (DE)

(73) Assignee: ALD VACUUM TECHNOLOGIES GMBH, Hanau (DE)

( * ) Notice: Subject to any disclaimer, the term of this patent is extended or adjusted under 35 U.S.C. 154(b) by 0 days.

(21) Appl. No.: 17/634,834

(22) PCT Filed: Aug. 12, 2020

(86) PCT No.: PCT/EP2020/072636
§ 371 (c)(1),
(2) Date: Feb. 11, 2022

(87) PCT Pub. No.: WO2021/028477
PCT Pub. Date: Feb. 18, 2021

(65) Prior Publication Data

US 2022/0410264 A1 Dec. 29, 2022

(30) Foreign Application Priority Data

Aug. 15, 2019 (DE) ..... 10 2019 122 000.9

(51) Int. Cl.
*B22F 9/08* (2006.01)

(52) U.S. Cl.
CPC ..... *B22F 9/082* (2013.01); *B22F 2009/0824* (2013.01); *B22F 2009/0836* (2013.01);
(Continued)

(58) Field of Classification Search
None
See application file for complete search history.

(56) References Cited

U.S. PATENT DOCUMENTS 3,692,290 A * 9/1972 Hager ..... C21C 5/567 75/10.67
4,925,103 A 5/1990 Muench et al.
(Continued)

FOREIGN PATENT DOCUMENTS

CN 107570719 A 1/2018
CN 108213449 A 6/2018
(Continued)

OTHER PUBLICATIONS

Sun, J. et al., "Separation of primary Si and impurity boron removal from Al-30%Si-10%Sn melt under a traveling magnetic field", China Foundry Research & Development, vol. 13, No. 4, Jul. 2016, pp. 284-288.*

(Continued)

*Primary Examiner* — George Wyszomierski
(74) *Attorney, Agent, or Firm* — Barnes & Thornburg LLP; Ryan L. Marshall

(57) ABSTRACT

The invention relates to a method for splitting an electrically conductive liquid, in particular a melt jet, comprising the steps providing the electrically conductive liquid which moves in a first direction (12) in the form of a liquid jet (10); and generating high-frequency travelling electromagnetic fields surrounding the liquid jet (10) which travel in the first direction (12) and accelerate the liquid jet (10) in the first direction (12), thereby atomizing the liquid jet (10).

17 Claims, 2 Drawing Sheets

(52) U.S. Cl.
CPC . *B22F 2009/084* (2013.01); *B22F 2009/0844* (2013.01); *B22F 2999/00* (2013.01)

(56) References Cited

U.S. PATENT DOCUMENTS

| | | | | |
|---|---|---|---|---|
| 10,946,449 | B2 | 3/2021 | Gerking et al. | |
| 2002/0076458 | A1 | 6/2002 | Tsao et al. | |
| 2002/0113151 | A1* | 8/2002 | Forber Jones | C23C 4/123 239/690 |
| 2007/0057416 | A1 | 3/2007 | Kennedy | |
| 2008/0093045 | A1 | 4/2008 | Rimmer et al. | |
| 2011/0168273 | A1 | 7/2011 | Morgenstern | |
| 2016/0052060 | A1 | 2/2016 | Eonta et al. | |
| 2016/0318105 | A1 | 11/2016 | Gerking et al. | |
| 2020/0122237 | A1* | 4/2020 | Kemper | B22F 3/003 |
| 2022/0168514 | A1* | 6/2022 | Sebastian | A61M 15/0085 |

FOREIGN PATENT DOCUMENTS

| | | | |
|---|---|---|---|
| CN | 108672709 | A | 10/2018 |
| CN | 108941590 | A | 12/2018 |
| CN | 109351982 | A | 2/2019 |
| DE | 102009035241 | A1 | 4/2010 |
| DE | 102013022096 | A1 | 6/2015 |
| EP | 0427379 | A2 | 5/1991 |
| EP | 2418035 | A2 | 2/2012 |
| RU | 2173609 | C1 | 9/2001 |
| SU | 958036 | A1 | 9/1982 |

OTHER PUBLICATIONS

English Translation of International Search Report dated Oct. 30, 2020, prepared in International Application No. PCT/EP2020/072636.

International Preliminary Report on Patentability dated Oct. 28, 2021, prepared in International Application No. PCT/EP2020/072636.

Ninagawa, Shingo et al., "Electromagnetic Atomization of Molten Metals", ISIJ International, vol. 31, No. 9, pp. 968-972, XP055821080, Sep. 15, 1991.

* cited by examiner

METHOD AND DEVICE FOR BREAKING UP AN ELECTRICALLY CONDUCTIVE LIQUID

This application is a National Stage application of International Application No. PCT/EP2020/072636, filed Aug. 12, 2020. This application also claims priority under 35 U.S.C. § 119 to German Patent Application No. 10 2019 122 000.9, filed Aug. 15, 2019.

The present invention concerns a method and a device for splitting, i.e. atomizing or spraying, an electrically conductive liquid. The atomizing of the electrically conductive liquid serves to split the electrically conductive liquid into micro-droplets. In particular, the method and the device according to the invention can be used for the production of high-purity spherical metal powders by atomizing or spraying of a melt jet.

BACKGROUND OF THE INVENTION

Methods and devices known from the state of the art for generating atomized microdroplets are often based on an inert gas atomization of a liquid or liquefied material. In practice, these methods are known in particular from the field of metal powder production. Herein, a melt jet of a metal or metal alloy melt is provided and atomized by means of an inert gas nozzle.

A disadvantage of such metal powder production methods is the high consumption of inert gas and the associated high operating costs.

It is therefore an object of the present invention to overcome the disadvantages of the state of the prior art. In particular, one task of the invention is to provide a method and a device for splitting an electrically conductive liquid, in particular a melt jet, which makes it possible to reduce operating costs.

The objects are solved by a method and a device for splitting an electrically conductive liquid according to the independent patent claims. Options and embodiments of the method and the device are the subject of the dependent claims and the description below.

DESCRIPTION OF THE INVENTION

The method of splitting an electrically conductive liquid, in particular a melt jet, comprises the step of providing the electrically conductive liquid moving in a first direction in the form of a liquid jet.

In the context of the present invention, splitting means the atomizing or spraying of the electrically conductive liquid. Here, the liquid jet designates a continuous liquid jet or at least a series of closely successive liquid drops. The liquid jet moves substantially along a stream center axis of the liquid jet in the first direction. In particular the electrically conductive liquid can be a metal or metal alloy melt provided in the form of a melt jet. However, the method and device according to the invention are not limited to the atomization of metal melts, but can be used for atomizing any electrically conductive liquid which can be influenced by means of travelling electromagnetic fields.

A further step of the method according to the invention is generating high-frequency travelling electromagnetic fields surrounding the liquid jet, which travel in the first direction and accelerate the liquid jet in the first direction, thereby atomizing the liquid jet.

More specifically, the high-frequency travelling electromagnetic fields travelling in the first direction can accelerate external layers of the liquid jet more than internal layers of the liquid jet due to their arrangement circumferentially around the liquid jet. The high-frequency travelling electromagnetic fields generate strong tangential components in the outer layers of the liquid jet, which in particular and substantially accelerate the outer layers. This results in a critical velocity profile with a large velocity gradient in the liquid jet, which can be represented in longitudinal section as a U-shaped velocity profile in the liquid jet. In particular a velocity profile of a laminar pipe flow can be substantially reversed into the U-shaped velocity profile. The pressure within the liquid jet is increased abruptly or suddenly compared to the pressure surrounding the liquid jet, so that the liquid jet is disintegrated or atomized due to the pressure difference. The atomizing or nozzling causes the liquid jet to disintegrate into ligaments, thus generating the desired microparticles. In addition to the pressure increase within the liquid jet, the liquid jet may also overheat.

In contrast to conventional atomization methods, the method according to the invention allows a homogeneous liquid jet, for example a melt jet, to be atomized by means of high-frequency travelling electromagnetic fields. No inert gas to be introduced is required for this, which means that the operating costs of the method can be reduced.

In an embodiment, the high-frequency travelling electromagnetic fields can have an alternating current frequency of at least 0.1 MHz, preferably at least 1 MHz, more preferably at least 10 MHz, still more preferably at least 100 MHz. For example, travelling electromagnetic fields can have an alternating current frequency between 0.1 MHz and 100 MHz. The alternating current frequency can be adjustable according to further method parameters, in particular depending on the material of the liquid jet to be atomized and/or the size of the microparticles or microdroplets to be generated.

According to an embodiment, the high-frequency travelling electromagnetic fields can be generated by means of a coil assembly with at least one pole pair, preferably with a plurality of pole pairs. For example, the coil assembly may comprise at least two pole pairs, more preferably at least three pole pairs, even more preferably at least four or more pole pairs. In the case of a coil assembly with a plurality of pole pairs, the pole pairs can each be arranged from along the stream center axis parallel to the adjacent pole pairs. The coil assembly can be controlled so that the high-frequency travelling electromagnetic fields travel in the first direction, i.e. they move substantially in the first direction.

In an embodiment, a further step of the method can be generating a gas stream surrounding the liquid jet, said gas stream moving substantially in the first direction and further accelerating the liquid jet in the first direction. The gas to be used is preferably an inert gas, for example argon. The gas may be at a high pressure, for example between 0 Pa and 10 MPa, preferably between 0.1 MPa and 5 MPa. The gas stream can be generated by means of an inert gas nozzle. The gas stream may impact on the liquid jet in the form of superimposed acceleration in addition to and in conjunction with the high-frequency travelling electromagnetic fields. The gas stream can accelerate the liquid jet simultaneously towards, in time and/or space before and/or in time and/or space after the coil assembly. The gas stream acts on the liquid jet via shear stresses. Thus the critical velocity profile (U velocity profile) and thus the high internal pressure in the liquid jet is set by means of the high-frequency travelling electromagnetic fields and by means of the gas stream, whereby the liquid jet is effectively atomized. Despite the additional application of a gas stream, the gas consumption can be reduced compared to conventional nozzling methods, since the atomization is not only caused by the gas stream, but also together with the travelling electromagnetic fields.

The inert gas nozzle can be a Laval nozzle.

In an embodiment, the high-frequency travelling electromagnetic fields can be generated by means of a coil assembly integrated in the inert gas nozzle. In this case, the liquid jet can be accelerated substantially simultaneously by means of the gas stream and the high-frequency travelling electromagnetic fields.

In an embodiment, the high-frequency travelling electromagnetic fields can be generated by means of a coil assembly mounted upstream or downstream along the stream center axis of the inert gas nozzle. In this case, the accelerations of the liquid jet by the high-frequency travelling electromagnetic fields and the gas stream act at least partially one after the other on the liquid jet or the at least partially already atomized liquid jet.

In an embodiment, the liquid jet can be atomized by means of a further gas stream introduced via an annular nozzle. This further gas stream can have an impulse-like or impact-like effect on the liquid jet or the at least partially atomized liquid jet. Inert gas can also be used as gas for this purpose, for example Argon. The annular nozzle can be located downstream of the coil assembly when viewed along the stream center axis. Seen along the stream center axis the annular nozzle can be mounted downstream of the inert gas nozzle.

The method can in particular be an EIGA method (EIGA, engl.: "Electrode Induction Melting (Inert) Gas Atomization") or it can be used in an EIGA method. The method can be a VIGA method (VIGA, engl.: "Vacuum Induction Melting combined with Inert Gas Atomization"), a PIGA method (PIGA, engl.: "Plasma Melting Induction Guiding Gas Atomization"), a CCIM method (CCIM, engl.: "Cold Crucible Induction Melting") or any other method for powder production.

The liquid jet can in particular be generated by melting a vertically suspended rotating electrode by means of a conical induction coil. For this purpose, the electrode can be moved continuously in the direction of the induction coil in order to be melted on or off without contact. The rotational movement of the electrode around its longitudinal axis can ensure a uniform melting of the electrode. The melting of the electrode and the atomizing of the generated melt jet can be done under vacuum or in an inert gas atmosphere to avoid undesired reactions of the melted material, for example with oxygen. The EIGA method can be used for the ceramic-free production of high-purity metal or precious metal powders, such as powders of titanium, zirconium, niobium and tantalum alloys.

In an embodiment, the method can further comprise the step of cooling the atomized liquid jet to generate solidified, in particular spherical, particles. The cooling can be performed under local cooling conditions. The cooling can also be actively influenced especially by a cooling device integrated in a collecting container.

A further aspect of the invention relates to a device for splitting an electrically conductive liquid, in particular a melt jet. The device comprises a liquid source for providing a liquid jet of the electrically conductive liquid moving in a first direction and a coil assembly with at least one pole pair, which is located downstream of the liquid source with respect to the direction of movement of the liquid jet and is arranged coaxially to the liquid jet with respect to a stream center axis. The coil assembly is adapted to generate high-frequency travelling electromagnetic fields surrounding the liquid jet and travel in the first direction to accelerate the liquid jet in the first direction by means of the high-frequency travelling electromagnetic fields and thereby atomize the liquid jet.

The device may be adapted to carry out the above described method for splitting the electrically conductive liquid.

According to an embodiment, the coil assembly for generating the high-frequency travelling electromagnetic fields may comprise my plurality of pole pairs. For example, the coil assembly may comprise at least two pole pairs, more preferably at least three pole pairs, still more preferably at least four or more pole pairs. The pole pairs of a plurality of pole pairs may each be arranged from along the stream center axis of the liquid jet parallel to the adjacent pole pairs. The coil assembly can be driven in such a way that the high-frequency travelling electromagnetic fields travel at a predetermined speed in the first direction, i.e. they travel at the predetermined speed substantially in the first direction.

In an embodiment, the high-frequency travelling electromagnetic fields can have an alternating current frequency of at least 0.1 MHz, preferably at least 1 MHz, more preferably at least 10 MHz, still more preferably at least 100 MHz. For example, travelling electromagnetic fields can have an alternating current frequency between 0.1 MHz and 100 MHz. The alternating current frequency can be adjusted or adjustable in accordance with the further method parameters, in particular depending on the material of the liquid jet to be atomized and/or the size of the microparticles or microdroplets to be generated.

According to an embodiment, the device may comprise an inert gas nozzle designed to generate a gas stream surrounding the liquid jet and moving substantially in the first direction, in order to additionally accelerate the liquid jet in the first direction by means of the gas stream. The gas stream can be an inert gas stream, wherein as inert gas for example argon can be used.

The gas stream can be generated by an inert gas nozzle in the form of a Laval nozzle.

In an embodiment, the coil assembly can be arranged or integrated in the inert gas nozzle. The coil assembly and the inert gas nozzle can be arranged coaxially to each other. In this case, the liquid jet can be accelerated substantially simultaneously by means of the gas stream and by means of the high-frequency travelling electromagnetic fields.

In an embodiment, the coil assembly can be arranged upstream or downstream of the inert gas nozzle, viewed along the stream center axis. In this case, the accelerations of the liquid jet by means of the high-frequency travelling electromagnetic fields and the gas stream act at least partially one after the other on the liquid jet or the at least partially already atomized liquid jet.

Due to the arrangement of the inert gas nozzle, the gas stream can impact on the liquid jet in the form of a superimposed acceleration in addition to and together with the high-frequency travelling electromagnetic fields. Thus, the critical velocity profile in the liquid jet can be adjusted by means of the high-frequency travelling electromagnetic fields and the gas stream to effectively atomize the liquid jet. Despite the additional application of a gas stream, the gas consumption can be reduced compared to conventional nozzling devices, because the atomization is not only achieved by the gas stream, but jointly with the travelling electromagnetic fields.

In an embodiment, the device may comprise an annular nozzle, wherein the annular nozzle is designed to additionally atomize the liquid jet by means of a further gas stream introduced via the annular nozzle. The annular nozzle can be set up to further atomize the liquid jet or the at least partially already atomized liquid jet by means of an impulse onto the liquid jet or the at least partially already atomized liquid jet. Inert gas can also be used for this purpose, for example argon. The annular nozzle can be located downstream of the coil assembly, viewed along the stream center axis. The annular nozzle can be located downstream of the inert gas nozzle when viewed along the stream center axis.

In an embodiment with one inert gas nozzle and one annular nozzle these two nozzles can be designed in one nozzle arrangement. The nozzle arrangement can be in one piece.

In an embodiment with an inert gas nozzle and an annular nozzle, the quality and/or the particle size of the powder to be produced can be influenced by the interaction and the adjustments of the coil assembly, the inert gas nozzle and the annular nozzle.

In an embodiment, the liquid source may be a melt jet source, in particular in the form of an electrode. In an embodiment, the liquid jet can be a melt jet of melted electrode material. The electrode can be a vertically suspended, rotatable electrode. For example, the electrode may comprise or consist of titanium, a titanium alloy, a zirconium-, niobium-, nickel- or tantalum-based alloy, a noble metal or alloy of noble metals, a copper or aluminum alloy, a special metal or alloy of special metals. The electrode may have a diameter greater than 50 mm and up to 150 mm and a length greater than 500 mm and up to 1000 mm.

Further the device may comprise a conical induction coil coaxial with the electrode and located in the region of a lower end of the electrode and adapted to melt the electrode to generate the melt jet. For this purpose the electrode may be continuously displaceable in the direction of the induction coil. The electrode and the induction coil may be located in a housing to which a vacuum or an inert gas atmosphere is applied.

In an embodiment, the device may comprise an atomization tower to cool and solidify the atomized liquid jet. This atomization tower may be connected to the enclosure and may also be supplied with vacuum or an inert gas atmosphere. The coil assembly, and the inert gas nozzle if fitted, may also be located in the enclosure in the region of the connection to the atomization tower. The atomization tower may be equipped with a cooling device to actively cool the atomized liquid jet and thus to influence particle formation in a targeted manner.

The device may be an EIGA system or may be installed in an EIGA system.

Although some aspects and features have only been described in relation to the method of the invention, these may apply to the device and embodiments accordingly, and vice versa.

BRIEF DESCRIPTION OF THE FIGURES

Embodiments of the present invention are explained in more detail below with reference to the enclosed schematic figures. It is depicted.

FIGURE DESCRIPTION

Figure 1:
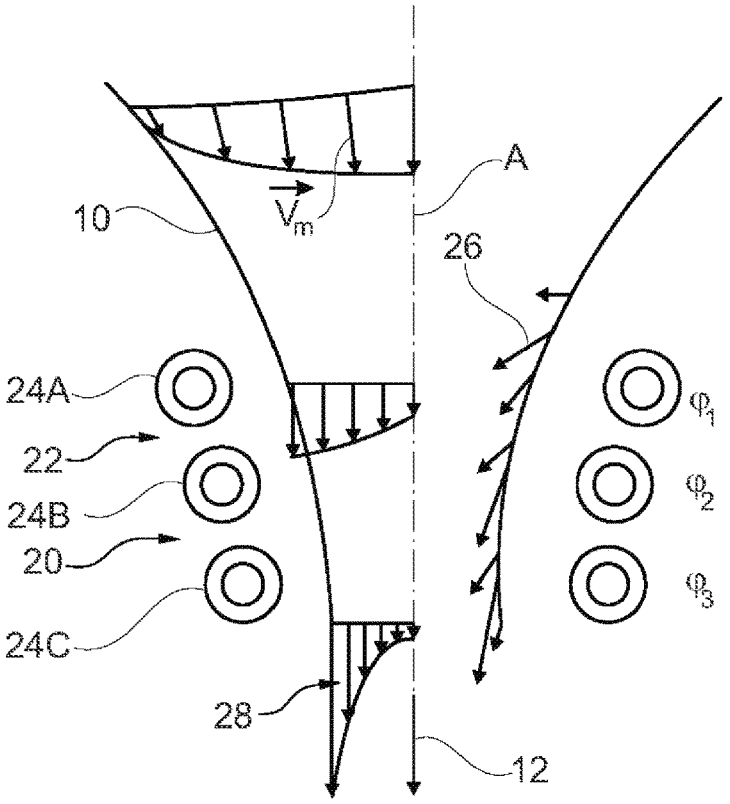
FIG. 1 a schematic representation of the mode of operation of the method according to the invention.

FIG. 1 shows a section of a liquid jet 10 of an electrically conductive liquid in a longitudinal section. In the present example, the liquid jet 10 is substantially a continuous melt jet of a metal melt. Starting from a liquid source (not shown), the liquid jet 10 moves in a first direction 12 along its stream center axis A. In the illustration of FIG. 1 shown, the liquid jet 10 falls from top to bottom due to the gravitational force.

The liquid jet 10 passes through a device (20) for atomizing the liquid jet 10. In the design example shown, the device 20 comprises a coil assembly 22 with three pole pairs 24A, 24B, 24C. It is understood that in alternative design examples the coil assembly may have more or less than three pole pairs. The coil assembly 22 is downstream of the liquid source not shown in the direction of movement and the windings are arranged parallel to each other and coaxial with the liquid jet 10.

The individual pole pairs 24A, 24B, 24C can be controlled one after the other in such a way that phase changes φi and hereby high-frequency travelling electromagnetic fields are generated. The sequence of the phase changes (pi is illustrated by the numbering φ1, φ2, φ3 as an example. The high-frequency travelling electromagnetic fields can, for example, have an alternating current frequency between 0.1 and 100 MHz.

The high-frequency travelling electromagnetic fields also move in the first direction 12 due to the phase change (pi. Due to the arrangement of the windings of the coil order 22 around the liquid jet 10, Lorentz forces 26 generated by the high-frequency travelling electromagnetic fields with strong tangential components mainly impact on external layers of the liquid jet 10 and additionally accelerate them in the first direction 12. Thus, outer layers of the liquid jet 10 are accelerated more strongly than inner layers of the liquid jet 10, resulting in a critical velocity profile with a large velocity gradient in the liquid jet. The velocities prevailing in the course of the liquid jet, which illustrate the velocity profiles within the liquid jet, are represented by the arrows $v_m$, wherein longer arrows indicate higher velocities and shorter arrows indicate lower velocities (for reasons of clarity, only one arrow is marked with the reference sign $v_m$). In the longitudinal section, the critical velocity profile at the exit of the liquid jet 10 from the coil assembly 22 is shown as a U-shaped velocity profile 28. The large velocity gradient within the liquid jet 10 increases the pressure within the liquid jet 10. This results in a large pressure difference between the high pressure within the liquid jet 10 and a much lower pressure surrounding the liquid jet. The pressure difference causes the liquid jet 10 to break up into ligaments, i.e. the liquid jet 10 is atomized into microparticles. The microparticles can, for example, have a mean particle size or a mean particle diameter $d_{50}$ between 20 μm and 100 μm.

Figure 2:
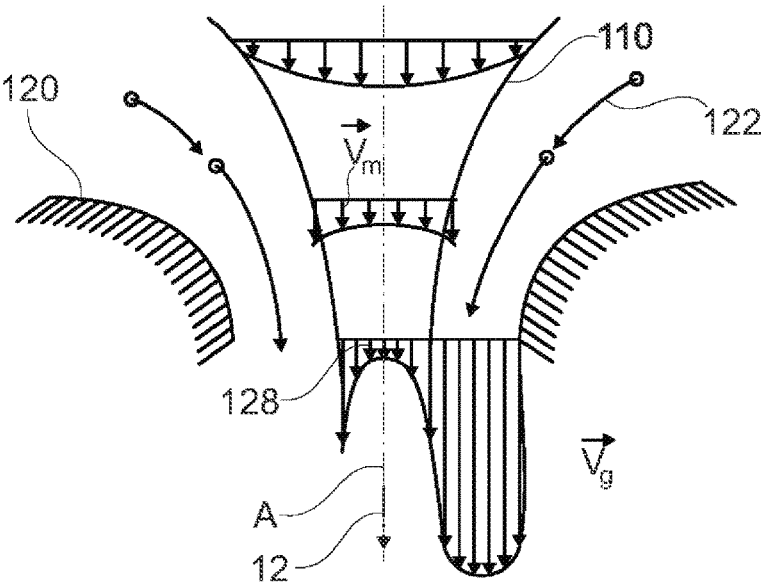
FIG. 2 a schematic representation of the mode of operation of a method of nozzling by means of a Laval nozzle.

FIG. 2 shows a section of a melt jet 110 of a metal melt in a longitudinal section. The liquid jet 110 is atomized by means of an inert gas nozzling method or a Laval nozzling. The melt jet 110 passes through an opening of an inert gas nozzle 120 to enter an atomization tower (not shown).

In contrast to the method shown in FIG. 1, the critical velocity profile in the melt jet 110 in the method shown in FIG. 2 is generated by an inert gas stream 122. The inert gas stream 122 flows through the inert gas nozzle 120 at a high velocity $v_g$ into the atomization tower. Since the melt jet 110 passes centrally through the inert gas nozzle 120, the inert gas flow 122 surrounds the melt jet 110 and acts via shear stresses on the outer layers of the melt jet 110. The outer layers of the melt jet 110 are thus accelerated more strongly in the first direction 12 than the inner layers of the melt jet 110. This generates a critical speed profile 128 within the melt jet 110 and atomizes the melt jet 110 after it leaves the inert gas nozzle 120 or enters the connected atomization tower.

Figure 3:
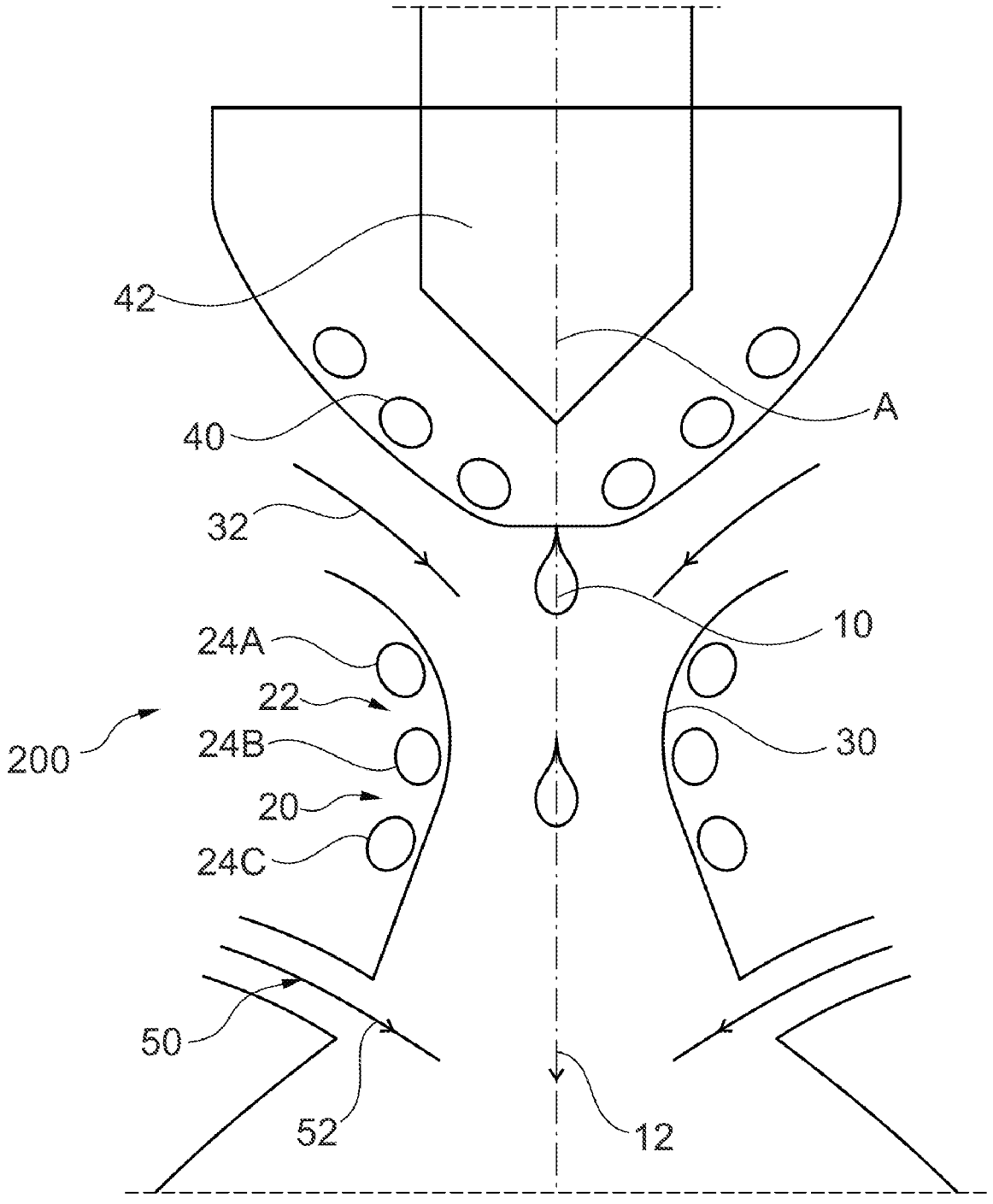
FIG. 3 shows a schematic representation of the mode of operation of the method according to the invention in an EIGA method.

FIG. 3 shows a schematic representation of the mode of operation of the procedure according to the invention in an EIGA method or a section of a sectional view of the device 20 according to the invention in an EIGA plant 200. The same components and features are provided with the same reference signs as in FIG. 1.

As can be seen in FIG. 3, the coil assembly 22 in the design example shown is integrated into an inert gas nozzle 30, which is designed in the form of a Laval nozzle. FIG. 3 thus shows an embodiment of the invention comprising a combination of the methods shown in FIGS. 1 and 2. This results in surprising synergy effects, which can lead to a further improved atomization.

The coil assembly 22 and the inert gas nozzle 30 are arranged coaxially, wherein the coil assembly 22 encloses the inert gas nozzle 30 and the interior of the inert gas nozzle 30, respectively. An inert gas stream 32 flows over the inert gas nozzle 30, which accelerates the liquid jet 10 consisting of several successive drops in a laminar manner (analogous to FIG. 2). This laminar acceleration through the inert gas nozzle 30 or through the intergas flow 32 (analogous to FIG. 2) is superimposed by an electromagnetic acceleration of the electrically conductive liquid jet 10 through the coil assembly 22 (analogous to FIG. 1).

Both accelerations together impact on the liquid jet 10 in such a way that it is accelerated in the first direction 12. These superimposed accelerations cause the formation of a critical U-shaped velocity profile in the liquid jet 10, corresponding to the velocity profiles of FIGS. 1 and 2. The large velocity gradient within the liquid jet 10 thus generated increases the pressure within the liquid jet 10, resulting in a large pressure difference between the high pressure within the liquid jet 10 and a much lower pressure surrounding the liquid jet. The pressure difference causes the liquid jet 10 to break up into ligaments, i.e. the liquid jet 10 is atomized into microparticles.

As also shown in FIG. 3, the liquid jet 10 is generated by the so-called EIGA method. For this purpose, an EIGA coil 40 or an induction coil 40 is mounted in front of the coil assembly 22 and inert gas nozzle 30. The induction coil 40 is arranged coaxially to the coil assembly 22 and the inert gas nozzle 30. The induction coil 40 is tapered when viewed in the first direction 12, i.e. it has a decreasing diameter when viewed in the first direction 12.

An electrode 42 is provided coaxially with the induction coil 40 and at least partially in front of it, which is melted off by means of the induction coil 40 in order to generate the liquid jet 10. The electrode shown may, for example, consist of titanium, a titanium alloy, an alloy based on zirconium, niobium, nickel or tantalum, a precious metal or a precious metal alloy, a copper or aluminum alloy, a special metal or special metal alloy. The electrode 42 is suspended at an upper end (not shown) and is axially displaceable in the first direction, i.e. in the direction of the arrangement of coil arrangement 22 and inert gas nozzle 30. This allows the electrode 42 to be continuously tracked during melting of the electrode 42.

Downstream of the coil assembly 22 and inert gas nozzle 30 is an annular nozzle 50, through which a further inert gas flow 52 can be introduced into the overall assembly. The further inert gas flow 52 in the design shown hits the liquid jet 10 emerging from the coil assembly 22 and inert gas nozzle 30 impulse-like or impact-like. The emerging liquid jet 10 may already be at least partially atomized when the further inert gas flow 52 from the annular nozzle 50 impacts on it. By the impact of the further inert gas stream 52 on the liquid jet 10 or the at least partially atomized liquid jet 10, it will be further nozzled.

As shown in FIG. 3, the coil assembly 22, the inert gas nozzle (Laval nozzle) 30 and the annular nozzle 50 can be designed as a common device 20. The device 20 can, for example, be in one piece.

The overall arrangement shown in FIG. 3 can be followed by an atomization tower for cooling and solidifying the atomized liquid jet, which is only indicated here and is not shown in full. The atomization tower may comprise a collecting tank for collecting the solidified powder.

It is understood that instead of the EIGA method for generating the liquid jet, alternative crucible-free methods or methods with crucibles may be provided, for example a VIGA method, a PIGA method, a CCIM method or any other method. Accordingly, in the system shown in FIG. 3, instead of the induction coil, one or more devices required for the above-mentioned methods may be provided upstream of the coil assembly.

It is understood that the method according to the invention and device according to the invention may also comprise a combination of a device with coil assembly and an annular nozzle, without inert gas nozzle, in an embodiment.

By means of the method according to the invention or the device according to the invention, operating costs can in particular be reduced compared to conventional inert gas nozzling methods by saving inert gas consumption.

LIST OF REFERENCE SIGNS

10 liquid jet
A stream center axis
12 first direction
20 device for atomizing the liquid jet
22 coil arrangement
24A, 24B, 24C pole pairs/windings
26 Lorentz forces
28 U-shaped speed profile
$v_m$ velocity within the liquid jet
$\varphi_i$, $\varphi_1$, $\varphi_2$, $\varphi_3$ phase change
30 inert gas nozzle (Laval nozzle)
32 inert gas flow
40 induction coil
42 electrode
50 annular nozzle
52 further inert gas flow
110 melt jet (SOTA)
120 Inert gas nozzle (SOTA)
122 Inert gas flow (SOTA)
128 velocity profile (SOTA)
200 EIGA system

The invention claimed is:

1. A method for splitting an electrically conductive liquid, comprising:

providing the electrically conductive liquid moving in a first direction in the form of a liquid jet; and generating high-frequency travelling electromagnetic fields surrounding the liquid jet that travel in the first directions to accelerate the liquid jet in the first direction thereby atomizing the liquid jet.

2. The method according to claim 1, wherein the travelling electromagnetic fields have an alternating current frequency of at least 0.1 MHz.

3. The method according to claim 1, wherein the high-frequency travelling electromagnetic fields are generated by means of a coil assembly with at least one pole pair.

4. The method according to claim 1, further comprising generating a gas stream surrounding the liquid jet, the gas stream moving substantially in the first direction and further accelerating the liquid jet in the first direction.

5. The method according to claim 1, further comprising generating a further gas stream impacting on the liquid jet by means of an annular nozzle.

6. The method according to claim 1, wherein the liquid jet is generated by melting an electrode by means of an induction coil.

7. The method according to claim 1 further comprising cooling the atomized liquid jet to generate solidified particles.

8. A device for splitting an electrically conductive liquid, comprising:

a liquid source for providing a liquid jet of the electrically conductive liquid moving in a first direction, and a coil assembly with at least one pole pair that is arranged downstream of the liquid source and coaxially with the liquid jet;

wherein the coil assembly is adapted to generate high-frequency travelling electromagnetic fields surrounding the liquid jet and travelling in the first direction to accelerate the liquid jet in the first direction by means of the high-frequency travelling electromagnetic fields and thereby atomize the liquid jet.

9. The device according to claim 8, wherein the high-frequency travelling electromagnetic fields have an alternating current frequency of at least 0.1 MHz.

10. The device according to claim 8 further comprising an inert gas nozzle adapted to generate a gas stream surrounding the liquid jet and moving substantially in the first direction to additionally accelerate the liquid jet by means of the gas stream in the first direction.

11. The device according to claim 10, wherein the coil assembly is arranged in the inert gas nozzle.

12. The device according to claim 10, wherein the coil assembly is arranged upstream of the inert gas nozzle viewed along the stream center axis.

13. The device according to claim 10, wherein the coil assembly is arranged downstream of the inert gas nozzle viewed along the stream center axis.

14. The device according to claim 8, which further comprises an annular nozzle for generating a further gas stream that is adapted to impact on the liquid jet.

15. The device according to claim 8, wherein the liquid source is an electrode, and the liquid jet is a melt jet.

16. The device according to claim 15, further comprising an induction coil arranged coaxially with the electrode and in the region of one end of the electrode, the induction coil being adapted to melt the electrode so as to generate the melt jet.

17. The device according to claim 8 comprising an atomization tower for cooling and solidifying the atomized liquid jet.

* * * * *